US012622536B2

(12) United States Patent
Glustsenko et al.

(10) Patent No.: US 12,622,536 B2
(45) Date of Patent: May 12, 2026

(54) FOLDABLE CARDBOARD STAND ASSEMBLY SYSTEM AND COMPACT BOX

(71) Applicant: Piar OÜ, Peetri (EE)

(72) Inventors: Ivan Glustsenko, Tallinn (EE); Aleksei Naumtsik, Viimsi (EE)

(73) Assignee: Piar OÜ, Peetri (EE)

( * ) Notice: Subject to any disclaimer, the term of this patent is extended or adjusted under 35 U.S.C. 154(b) by 0 days.

(21) Appl. No.: 18/939,993

(22) Filed: Nov. 7, 2024

(65) Prior Publication Data

US 2025/0143486 A1 May 8, 2025

Related U.S. Application Data

(60) Provisional application No. 63/597,187, filed on Nov. 8, 2023.

(51) Int. Cl.
*A47F 5/11* (2006.01)
*A47B 47/06* (2006.01)

(52) U.S. Cl.
CPC ..... *A47F 5/116* (2013.01); *A47B 47/06* (2013.01)

(58) Field of Classification Search
CPC ..... A47B 55/06; A47B 43/02; A47B 47/06; A47F 55/11; A47F 55/112; A47F 55/114; A47F 55/116
See application file for complete search history.

(56) References Cited

U.S. PATENT DOCUMENTS 3,656,611 A * 4/1972 Mertz ..... B65D 5/48024 206/45.21
5,193,466 A * 3/1993 Eder ..... A47F 5/116 108/166
5,213,220 A * 5/1993 McBride ..... A47B 55/06 211/132.1
5,458,411 A * 10/1995 Moss ..... A47B 47/06 312/259
5,632,390 A * 5/1997 Podergois ..... A47F 5/116 211/195
5,826,732 A * 10/1998 Ragsdale ..... A47F 5/116 108/165
6,382,433 B1 * 5/2002 Podergois ..... A47F 5/10 211/195

(Continued)

FOREIGN PATENT DOCUMENTS

BR PI1105293-7 A2 9/2015
CA 2165218 A1 * 6/1996 ..... A47F 5/116

(Continued)

*Primary Examiner* — Patrick D Hawn
(74) *Attorney, Agent, or Firm* — Koivula & Somersalo LLC

(57) ABSTRACT

The invention discloses an easily assemblable cardboard stand assembly system designed to streamline its setup process while ensuring a compact sized transport and/or storage box. The stand assembly system is foldable and complete (does not require assembly of parts when set up (erected) by a consumer and does not require disassembly for transport and/or storage). The stand assembly system comprises technical features that eliminate the need for additional mechanical connections, adhesive materials or double-sided tape points. The invention addresses the demand for an environmentally friendly, user-friendly and efficient cardboard stand assembly system.

5 Claims, 4 Drawing Sheets

(56) References Cited

U.S. PATENT DOCUMENTS

| | | | | |
|---|---|---|---|---|
| 6,612,669 | B2 * | 9/2003 | Grueneberg | A47B 43/02 108/165 |
| 7,252,200 | B1 * | 8/2007 | Hester | A47F 5/116 211/187 |
| 8,091,715 | B2 * | 1/2012 | Roth | A47B 57/20 211/187 |
| 8,651,296 | B2 * | 2/2014 | Beaty | A47F 5/11 211/72 |
| 8,651,297 | B2 * | 2/2014 | Beaty | A47F 5/116 211/72 |
| 8,875,908 | B2 * | 11/2014 | L'Hotel | A47F 5/116 211/195 |
| 8,944,260 | B2 * | 2/2015 | Hawkins | A47B 43/02 248/152 |
| 9,474,389 | B2 * | 10/2016 | Pfeifer | A47F 5/11 |
| 9,844,282 | B2 * | 12/2017 | Smith | A47B 43/02 |
| 10,016,075 | B1 * | 7/2018 | Kula | A47F 5/0062 |
| 10,117,529 | B2 * | 11/2018 | Abel | A47F 5/116 |
| 10,888,180 | B2 * | 1/2021 | Robinson | A47F 5/16 |
| 11,457,751 | B2 * | 10/2022 | Nguyen | A47B 43/02 |
| 11,744,388 | B2 * | 9/2023 | Pratsch | A47F 5/116 211/126.16 |
| 2005/0274684 | A1 * | 12/2005 | Swanson | A47B 49/00 211/78 |
| 2010/0006529 | A1 * | 1/2010 | Groff | A47F 5/116 211/186 |
| 2018/0289178 | A1 * | 10/2018 | Mcmillan-Sweat | A47F 5/116 |
| 2022/0257011 | A1 * | 8/2022 | McLeod | B65D 5/48034 |

FOREIGN PATENT DOCUMENTS

| | | | | |
|---|---|---|---|---|
| DE | 202014106151 | U1 * | 2/2015 | A47F 5/116 |
| DE | 202015102755 | U1 * | 7/2015 | A47F 5/114 |
| DE | 102016222955 | A1 * | 5/2018 | A47F 5/116 |
| EP | 2181627 | A1 * | 5/2010 | A47F 5/116 |
| EP | 2661991 | A1 * | 11/2013 | A47F 5/116 |
| KR | 20100034181 | A * | 4/2010 | A47B 47/021 |
| PL | 68840 | Y1 | 3/2013 | |
| PL | 221005 | B1 | 2/2016 | |

* cited by examiner

FOLDABLE CARDBOARD STAND ASSEMBLY SYSTEM AND COMPACT BOX

PRIORITY

This application claims priority to U.S. provisional application 63/597,187 filed on Nov. 8, 2023, and to European application EP24191134.6 filed on Jul. 26, 2024, the contents of which are incorporated herein by reference.

TECHNICAL FIELD

The invention belongs to the field of cardboard structures and is particularly focused on an easily assemblable (erectable) cardboard stand assembly system, which allows for the use of a reduced transport box size, simplified assembly of the stand assembly system, and absence of supplementary mechanical connections, adhesives, or double-sided tape points.

BACKGROUND OF THE INVENTION

Conventional cardboard stand assemblies often involve multiple components, additional mechanical connections, or application of adhesives, which complicate the assembly and reduce the structural integrity of the final product. Moreover, conventional cardboard stand assemblies require large transport boxes which may increase logistics costs and environmental impact. Accordingly, there is a need for cardboard stand assemblies that are easy to assemble, without additional connections and which would allow for small-sized transportation packages.

There is a known stand (display stand) for display and advertising of goods (PL221005B1, Holbox Poland Spolka Z Ograniczona Odpowiedzialnoscia, published on Sep. 24, 2012), which is a prism-like casing with shelves, which has a movable partition wall with an advertising board (header) and a base. A drawback of this solution is that the consumer must assemble the stand from parts, using additional connecting materials (adhesive, tape, etc.); moreover, the stand assembly is not foldable and requires a lot of space during transport and storage.

There is a known "Exposition shelf unit" (PL66840Y1, Holbox Poland Spolka Z Ograniczona Odpowiedzialnoscia, published on Mar. 18, 2013), which is a parallelepiped made from rigid material with one-sided shelves where each shelf has a supporting element which has a base part. The support element is a cross beam attached to the two-part side wall. For this solution, shelves are only on one side of the stand, which leaves less space for displaying goods. Also, the stand cannot be folded, therefore it requires a lot of space during transport and storage.

Closest solution to the invention is a display stand with shelves (BRPI1105293-7 A2, Holbox BV, published on Sep. 1, 2015), which comprises two parts of casing interconnected with a partition wall, connected by prongs and grooves, additionally comprising a base and a header. A drawback of this solution is that the consumer must assemble the stand from parts; moreover, the stand assembly system is not foldable and requires a lot of space during transport and storage.

SUMMARY OF THE INVENTION

The invention pertains to an easily assemblable (erectable) cardboard stand assembly system designed to streamline the assembly process while ensuring a compact sized transport and/or storage box for the stand assembly system. The stand assembly system has features that eliminate the need for additional mechanical connections, adhesive materials, or double-sided tape points in order to set up (erect) the assembly. The invention addresses the demand for an environmentally friendly, user-friendly and efficient cardboard stand assembly system.

The foldable stand assembly system comprises precut and scored cardboard panels equipped with interlocking mechanisms. This mechanism facilitates a straightforward and secure assembly process of the stand assembly system without the need of external tools or adhesives, for instance, mechanical connections, adhesives or double-sided tape points. The cardboard stand assembly system is designed to fold easily, ensuring a compact transport and/or storage box size while allowing for efficient setup (in the assembled state) and folding (in the not assembled state) of the stand assembly system.

The invention presents a foldable cardboard stand assembly comprising shelf assemblies that are vertically on top of each other, where the shelf assembly comprises shelves positioned back-to-back, which are mirror images of one another. The stand assembly system has outer foldable vertical support elements that are mirror images of one another, which include folding lines and incisions with inner horizontal prongs and grooves. The shelf has horizontal surfaces and a supporting structure, which together create a shelf module. The horizontal surfaces of the shelf are supported by the horizontal prong of the vertical support element, and they interlock with a groove in the prong. The stand assembly system has a bottom support element (a base) that is connected between the outer vertical support elements. The stand assembly has a fixable head piece. Structural stability of the stand assembly is ensured by its structural elements and locking mechanisms.

The stand assembly is foldable both vertically height-wise (can be folded down) and horizontally depth-wise (can be accordion-folded or pressed together). The stand assembly is complete (does not require assembly from parts by the consumer upon setup (erection), nor disassembly into parts for transport and/or storage purposes).

EMBODIMENT OF THE INVENTION

Figure 1:
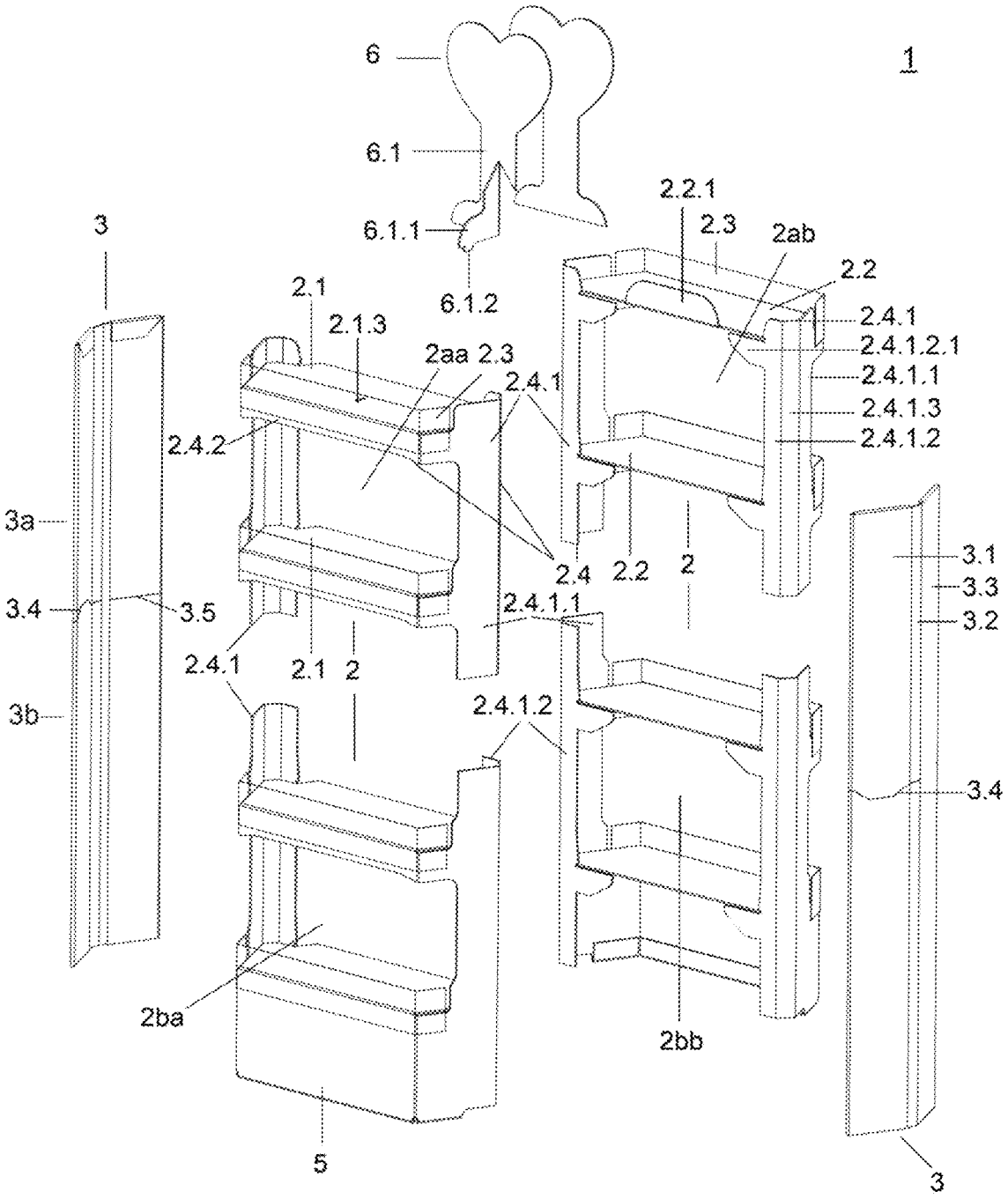
FIG. 1 shows the main parts of the stand assembly (layout drawing).
Figure 2:
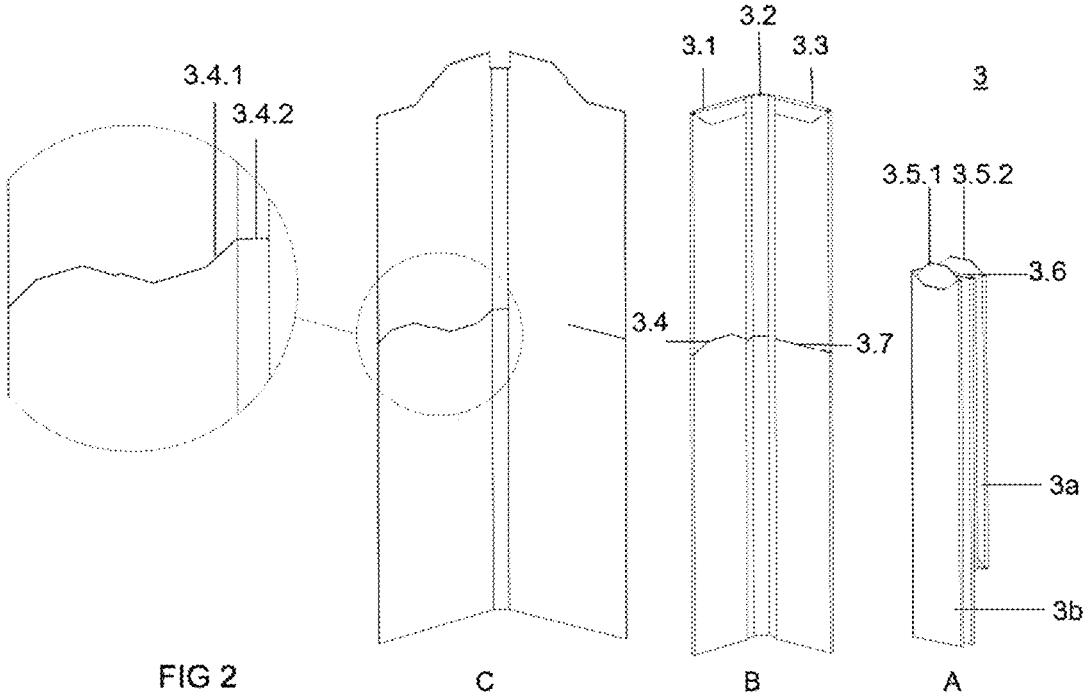
FIG. 2 shows outer vertical support elements—A is in flat and folded state; B is in partially unfolded state; C is in completely unfolded state.

The invention discloses a foldable stand assembly system comprising precut and scored cardboard panels equipped with interlocking mechanisms. The provided solution facilitates a straightforward and secure assembly process of the stand assembly system without the need of external tools or adhesives, for instance, mechanical connections, adhesives or double-sided tape points. The cardboard stand assembly system is designed to fold easily, ensuring a compact transport and/or storage box size while allowing for efficient setup (in the assembled state) and folding (not in the assembled state).

The foldable cardboard stand assembly system 1 comprises back-to-back shelves 2 forming shelf modules and forming a shelf assembly 4 comprising individual shelf assembly parts when placed vertically on top of one another and connected with support element 3.

The stand assembly system 1 can be folded for transport and/or storage both vertically height-wise (i.e. folded down to make it lower) and also horizontally depth-wise (i.e. accordion-folded or pressed together) and can be placed into a compact box.

In the stand assembly system 1, shelf assemblies 4 are supported by outer vertical support elements 3 at their vertical ends, which are mirror images of one another and can be folded both vertically and horizontally.

Support element 3 comprises two wider outer portions 3.1 and 3.3, and a narrower middle portion 3.2 in between. The wider outer portions 3.1 and 3.3 of the support element have been designed at an angle to the middle portion 3.2. At the junction of the wider outer portions 3.1, 3.3 and the narrower middle portion 3.2 there are folding lines, which facilitate pressing the support elements 3 together to make them horizontally narrower (accordion-fold) depth-wise (wider outer portions 3.1 and 3.3 are pushed (pressed) together against each other's inner side, and the narrower middle portion 3.2 is pushed out from between the wider outer parts 3.1 and 3.3 as a protrusion). The upper edge of support element 3 is shaped, the lower edge is flat.

The shape of the shelf assembly 4 is polyhedron, and in preferred embodiment it comprises two shelves 2 connected back-to-back-—he inner edge of shelf 2 is connected in mirror image to another equal shelf, forming a shelf module.

In the preferred embodiment, the shelf 2 comprises two shelf modules placed vertically on top of each other—the upper shelf module 2*aa* and 2*ab* and the lower shelf module 2*ba* and 2*bb*. Shelf modules 2*aa* and 2*ab* and 2*ba* and 2*bb* are interconnected back-to-back. Optionally, shelf 2 may comprise at least one set of intermediate shelf module (not shown in the figures).

The shelf module preferably has two horizontal surfaces (is two-storied). The horizontal surface comprises the first horizontal surface 2.1, with a prong 2.1.1 on the inner edge and grooves 2.1.2 at the ends of the inner edge, and the second horizontal surface 2.2 with a foldable flap 2.2.1. The horizontal surfaces 2.1 and 2.2 are interconnected with the prong 2.1.1. Optionally, the shelf module may have at least one additional intermediate surface or intermediate floor (not shown in the figure).

At the junction of the first horizontal surface 2.1 and the prong 2.1.1 there are folding lines, which facilitate pressing the first horizontal surface 2.1 and the second horizontal surface 2.2 together to make them horizontally narrower (into accordion-fold) depth-wise, pressing them together towards (against) each other's inner side.

There is a hole 2.1.3 in the first horizontal surface 2.1 of the upper shelf module 2*aa* of shelf 2 of the upper shelf assembly 4*a* of the shelf assembly 4.

The shelf 2 has a support structure 2.4 with a vertical portion 2.4.1 and a horizontal portion 2.4.2. The vertical portion 2.4.1 of the support structure 2.4 of the shelf 2 comprises vertical support structures (support posts) at the ends of shelf 2, which are mirror images of each other, and horizontal portions 2.4.2 connecting those i.e. horizontal support structures (support beams). The vertical part 2.4.1 comprises three faces bent to an angle—a wider outer portion 2.4.1.1, a narrower inner portion 2.4.1.2 and a middle connecting portion 2.4.1.3. There are folding lines at the junction of the wider outer portion 2.4.1.1, the middle connecting portion 2.4.1.3 and the narrower inner portion 2.4.1.2, which makes it possible to press the vertical portion 2.4.1 of the support structure 2.4 together (depth-wise) to make it horizontally narrower (wider outer portions 2.4.1.1 are pushed (pressed) into accordion-fold towards (against) the inner side of the middle interconnecting portions 2.4.1.3 and the narrower inner portions 2.4.1.2).

The narrow inner portion 2.4.1.2 of the vertical part of the support structure has a horizontal prong 2.4.1.2.1 extending into the shelf module (and shelf assembly 4), and when the stand 1 is in assembled state, the horizontal surfaces 2.1 and 2.2 of the shelf 2 are supported by it. At the connection point between the horizontal prong 2.4.1.2.1 and the upper edge of the narrow inner part 2.4.1.2, there is a notch 2.4.1.2.2 (locking hole), which, in the assembled state of the stand 1, is intended to lock the first horizontal surface 2.1 of the shelf 2 to the narrow inner part 2.4.1.2 of the support structure's vertical part 2.4.1 (into the notch 2.4.1.2.2 (locking hole)). The incision 2.1.2 of the first horizontal surface 2.1 is equal to the width of the narrow inner part 2.4.1.2 of the shelf support structure's vertical part 2.4.

The upper edge 2.3 of the shelf is attached to the upper edge of the support structure's horizontal portion 2.4.2.

The ends of the shelves 2 are cut at an angle so that they align with the inner portions (inner sides) of the wider outer part 2.4.1.1 and the middle connecting portion 2.4.1.3 of the vertical part 2.4.1 of the shelf support structure 2.4.

The vertical portion 2.4.1 of the shelf support structure is connected to the outer vertical support element 3. By attaching multiple separate shelf assembly portions (e.g., the upper shelf assembly part 4*a* and the lower shelf assembly part 4*b*) to the outer vertical support element 3, a complete vertical shelf assembly 4 is formed from these multiple shelf assembly portions. The upper shelf assembly portion 4*a* and the lower shelf assembly portion 4*b* are not interconnected through the vertical portions 2.4.1 of the support structure.

By placing the shelf assemblies 4 on top of each other, a stand assembly system 1 is formed. In the preferred embodiment, the stand assembly system 1 comprises two separate shelf assemblies 4 stacked on top of each other—the separate upper shelf assembly portion 4*a* and the separate lower shelf assembly portion 4*b*. Optionally, there can also be at least one separate intermediate shelf assembly part (not shown in the figure), which lacks some features of the upper shelf assembly portion 4*a* and the lower shelf assembly portion 4*b*, such as the header element 6 of the upper shelf 2*ab* and the base 5 of the horizontal surface of the lower shelf 2*ba*, 2*bb*.

The outer vertical support elements 3 can be folded horizontally to a narrower width and folded down vertically to a lower height. For folding, one of the wider portions of the outer support element, such as 3.1, and the narrower middle part 3.2 have at least one incision 3.4, while the other wider support element, such as 3.3, has at least one folding line 3.7. In the preferred embodiment, the incision 3.4 partially divides the outer vertical support element 3 notionally into an upper portion 3*a* and a lower portion 3*b*. Depending on the length of the vertical support element 3, it may have more than one incision 3.4 and more than one folding line 3.7, and, respectively, also some additional parts of the vertical support element 3 (not shown in the figure). The incision 3.4 includes a shaped line 3.4.1 on the wider portion of the support element (e.g., 3.1) and a straight line 3.4.2 on the narrower middle portion 3.2, while the folding line 3.7 is a straight line.

To ensure vertical stability and additional rigidity of the assembled stand assembly system 1, the wider part of the outer vertical support element 3, such as 3.1, features opposing vertical prongs 3.5.1 and 3.5.2 on both portions (3*a* and 3*b*) of the incision 3.4 (for example, the upper portion 3*a* of the outer vertical support element has a prong on the outer side, while the lower portion 3*b* has a prong on the inner side). When placing the outer vertical support element 3 into use (during the assembly of the stand 1), the opposing vertical prongs 3.5.1 and 3.5.2 interlock behind each other. On the upper portion 3*a* of the outer vertical support element, there is a slot 3.6 behind the vertical prong 3.5.2, into which the vertical prong 3.5.1 on the lower portion 3*b* of the outer vertical support element fits, which ensures vertical stability of the assembled stand, as it interlocks the upper portion 3*a* and lower portion 3*b* of the outer vertical support element. The slot 3.6 is formed between the inner side of the outer vertical support element 3 and the lower edge of the vertical portion 2.4.1 of the support structure of the upper shelf module 2*aa*, 2*ab* attached to it.

The folding line 3.7 (and the incision 3.4) allows the shelf assembly 4 to be folded vertically in such a way that the upper shelf assembly 4*a* is bent down against the side of the lower shelf assembly 4*b*. The bending down occurs in the direction away from the incision 3.4.

The upper shelf 2*ab* of the shelf assembly 4*a* of the stand 1 comprises a vertical header element 6. The header element 6 is attached to the foldable flap 2.2.1 on the second horizontal surface 2.2 of the upper shelf module 2*ab*. The header element 6 has a support leg 6.1 comprising a foldable prong portion 6.1.1 of the support leg, which comprises a fastener 6.1.2 that is inserted into the hole 2.1.3 on the first horizontal surface 2.1. The header element 6 additionally connects the first horizontal surface 2.1 and the second horizontal surface 2.2 of the upper shelf module 2*aa* and 2*ab*, thereby further securing the stand assembly system 1 into its three-dimensional set-up state.

The horizontal part 2.4.2 of the support structure of the lower shelf 2*ba*, 2*bb* of the shelf assembly 4*b* of the stand 1 forms the lower support element, i.e., the base 5, which provides vertical stability to the stand 1 in its upright assembled position (the erected shelf rests on the bottom support element or base 5 and on the lower ends of the outer vertical support elements 3). The base 5 is also the support beam 2.4.2 of the support structure with extended edges (a special case of the support beam).

The stand assembly system 1 is complete and pre-assembled for the consumer, meaning that it does not require assembly from parts by the consumer, nor does it need to be disassembled into parts for transport and/or storage purposes. The stand assembly system according to the invention significantly reduces the size of the box used for its transport and/or storage. The stand assembly system is easy and safe to set up (erect) without the need for external tools or connection means, such as mechanical connections, adhesives, or double-sided tape points.

When not in use, the stand assembly system 1 is in a folded position (accordion-folded horizontally and folded vertically to a lower height). A compact (rectangular-shaped) box is provided for transporting and/or storing the stand assembly system.

Components of the stand assembly system and their use in assembling a complete stand assembly system (in the factory) (see FIG. 1):

1) pre-assembled shelf modules 2*aa*, 2*ab* and 2*ba*, 2*bb* are used;
2) to assemble shelf 2, the back-to-back shelf modules 2*aa* and 2*ab* are connected with 2*ba* and 2*bb*—this is done by connecting the first horizontal surface 2.1 and the second horizontal surface 2.2 using the prong 2.1.1;
3) to form the (vertical) shelf assembly 4, the separate upper shelf assembly 4*a* is connected to the upper part 3*a* of the outer vertical support element using the shelf support structure 2.4, while the lower shelf assembly 4*b* is connected to the lower portion 3*b* of the outer vertical support element;
4) the header element 6 is attached to the foldable flap 2.2.1;
5) the folded stand assembly system is stored in the compact box.

To set up (erect) the cardboard stand assembly system, the user first unfolds the pre-assembled panels, aligns the locking mechanism, and secures the panel firmly without additional mechanical connections, adhesives or double-sided tape. This easy and tool-free assembly process enhances user convenience and reduces assembly time.

Figure 3:
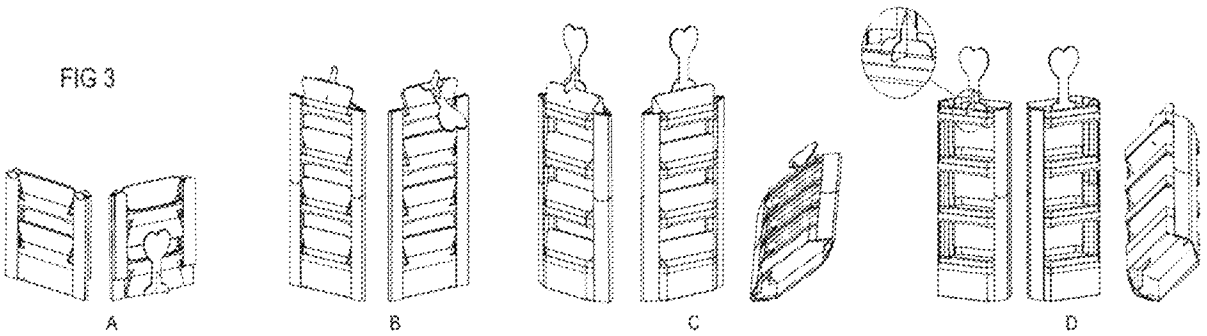
FIG. 3 illustrates unfolding of the elements of the stand assembly system—A is in fully flat and folded state; B is in flat and partially unfolded state; C is in fully unfolded state and partially three-dimensional state; D is in ready-to-use state where head piece supports the three-dimensional shape of the stand assembly system.
Figure 4:
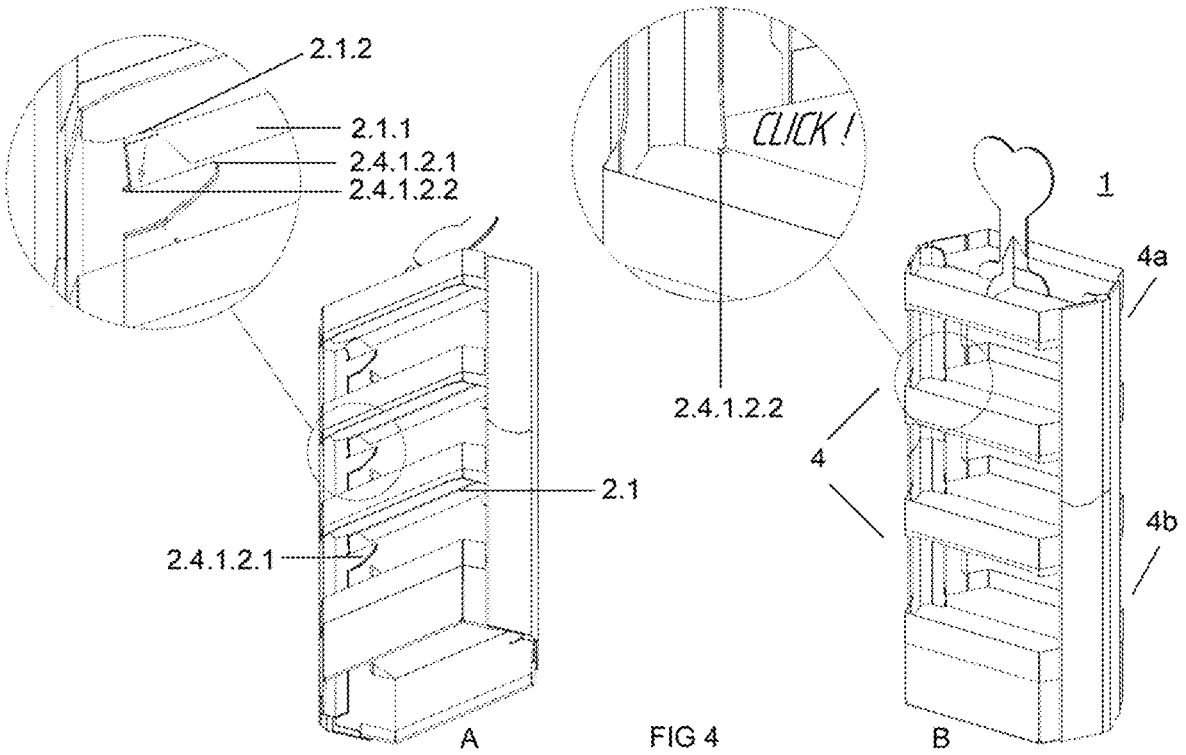
FIG. 4 shows a detailed view of the connections of the support structure.

Setup of the stand assembly system by the user (see FIG. 3B to FIG. 3D)—the complete stand assembly system 1 is delivered from the factory in a folded state and is packed in a compact box:

1) to set up the stand assembly system 1, it is removed from the box and unfolded;
2) the vertical support elements 3 are erected—the upper part 3*a* of the outer vertical support element is lifted onto the lower part 3*b* and the vertical prongs 3.5.1 and 3.5.2 are locked;
3) all horizontal surfaces 2.1 and 2.2 of the shelves 2 are pressed downward so that they rest on the horizontal prong 2.4.1.2.1 of the support structure, and the horizontal surfaces 2.1 and 2.2 are locked with a click (FIG. 4A, 4B) into the notch 2.4.1.2.2 (locking hole) located at the junction of the upper edge of the narrow inner portion 2.4.1.2 of the vertical part of the support structure and the horizontal prong 2.4.1.2.1;
4) when pressing the horizontal surfaces 2.1 and 2.2 of the shelves 2 downward, the vertical parts 2.4.1 of the shelf support structure 2.4 expand in width, which in turn expands the outer vertical support elements 3 in width;
5) the stand assembly system 1 is expanded to its width and, when set up in upright position, rests on the base surface on the lower ends of the outer vertical support elements 3 and the base 5;
6) the header element 6 is lifted with the flap 2.2.1, and the fastener 6.1.2 of the foldable extending support leg portion 6.1.1 of the header element 6 is inserted into the hole 2.1.3, which additionally secures (locks) the stand assembly system 1 in its three-dimensional upright set up position.

Folding the stand assembly system into its compact (folded) state (for transport or storage see FIG. 3A):

1) the header element 6 is released from the hole 2.1.3 and folded with the flap 2.2.1;
2) all horizontal surfaces 2.1 and 2.2 are released from the notches 2.4.1.2.2 (locking hole);
3) the outer vertical support elements 3 and the shelf support structures 2.4 are folded horizontally (accordion-folded) to a narrower width while folding the horizontal surfaces 2.1 and 2.2 together in the upward direction;

4) the stand 1 is folded vertically from the vertical support elements 3 and the stand 1 then placed (optionally) into a folded compact box.

The invention has several important advantages, including (but not limited to):

compact size of the transport and/or storage box;
lower storage and/or transport costs;
tool-free setup (erecting and folding);
increased structural stability and strength;
environmentally friendly design using recyclable materials.

LIST OF ELEMENT NUMBERS

1—stand assembly system
2—shelf (comprises at least two horizontally positioned surfaces at different heights)
2*aa*, 2*ab*—upper shelf module
2*ba*, 2*bb*—lower shelf module
2.1—first horizontal surface, which has a prong on its inner edge and incisions at the ends of the inner edge
2.1.1—prong at the inner edge of the first horizontal surface 2.1
2.1.2—incision at the end of the inner edge of the first horizontal surface 2.1
2.1.3—hole on the upper (top) horizontal surface 2.1
2.2—second horizontal surface
2.2.1—foldable flap on the second upper (top) horizontal surface 2.2
2.3—upper edge of the shelf
2.4—support structure of the shelf
2.4.1—vertical portion of the support structure (vertical structure or support post) of the shelf
2.4.1.1—wider outer part of the vertical portion of the support structure of the shelf
2.4.1.2—the narrow inner part of the vertical portion of the support structure of the shelf
2.4.1.2.1—horizontal prong of the narrow inner part 2.4.1.2 of the vertical support structure (into the interior of the shelf assembly) of the shelf
2.4.1.2.2—notch (locking hole) at the junction of the narrower inner part 2.4.1.2 of the vertical support structure of the shelf and the upper edge of the horizontal prong 2.4.1.2.1
2.4.1.3—central connecting part of the vertical portion of the support structure of the shelf
2.4.2—horizontal portion of the support structure (horizontal structure or support post) of the shelf
3—outer vertical support element
3*a*—upper portion of the outer vertical support element
3*b*—lower portion of the outer vertical support element
3.1, 3.3—wider outer portion of the outer vertical support element
3.2—narrower middle portion of the outer vertical support element
3.4—incision on one of the wider outer parts of the support element (e.g., 3.1) and the narrower middle part (3.2)
3.4.1—shaped line of the incision
3.4.2—straight line of the incision
3.5.1—vertical prong extending from the inner side of the incision 3.4 of the support element (projecting from the lower side 3*b* of the wider outer portion of the outer vertical support element, e.g. 3.1)
3.5.2—vertical prong extending from the outer side of the incision 3.4 of the support element (projecting from the upper side 3*a* of the wider outer portion of the outer vertical support element, e.g. 3.1)
3.6—slot behind the vertical prong 3.5.2 on the upper part 3*a* of the outer vertical support element
3.7—folding line on the second wider outer portion of the support element (e.g. 3.3)
4—shelf assembly
4*a*—upper portion of the shelf assembly
4*b*—lower portion of the shelf assembly
5—bottom support element, or base, of the (most) bottom shelf module 2*ba*, 2*bb* (which also serves as an extended edge of the shelf support structure's support beam 2.4.2 (a special case of the beam))
6—header element (attached to the foldable flap 2.2.1)
6.1—support leg of the header element
6.1.1—foldable extending portion of the support leg
6.1.2—fastener of the foldable extending portion 6.1.1 of the support leg inserted into the hole 2.1.3

The invention claimed is:

1. A foldable cardboard stand assembly system, comprising:

a plurality of shelves with a back-to-back arrangement;
a plurality of outer vertical support elements;
a support structure of the shelves;
a first and second horizontal surface of the shelves:
an outer edge;
one or more locking mechanisms;
a base; and
a header element;

wherein the back-to-back shelves are configured to form shelf modules, and the shelf modules are configured to form a shelf assembly when stacked vertically on top of each other;

the shelf assembly comprising a separate upper portion and a lower portion;

the shelf further comprises a first horizontal surface of the shelves, with a prong on an inner edge and one or more grooves at ends of the inner edges, and a second horizontal surface of the shelves with a foldable flap configured to connect the first and the second horizontal surfaces of the shelves with each other and having one or more folding lines at a junction of the first horizontal surface of the shelves and the prong;

the first horizontal surface of the shelves and the second horizontal surface of the shelves configured to be folded horizontally to a narrower width using the one or more folding lines;

a hole in the first horizontal surface of the shelves;

the shelves support structure comprising vertical portions of the support structure at each end of the shelves the support structures being mirror images of each other, and a horizontal portion of the support structure connecting the support structures vertical portions, and;

the vertical portions of the support structure comprising three faces bent to an angle, the three faces being a wider outer portion, a narrower inner portion, and a middle connecting portion;

and the vertical portions of the support structure comprising folding lines at a junction of the wider outer portion, a middle connecting portion and the narrower inner portion;

the wider outer portion, the narrower inner portion and the middle connecting portion being vertically foldable to a narrower width using the folding lines;

the narrower inner portion having a horizontal prong extending into the interior of the shelf assembly, the horizontal prong configured to support the horizontal surfaces;

a notch at a junction of the horizontal prong and an upper edge of the narrower inner portion, configured to lock the first horizontal surface of the shelves to the narrower inner portion of a vertical portion of the support structure;

an incision of the first horizontal surface of the shelves being equal to the width of the narrower inner portion of a vertical portion of the support structure;

an upper edge of the shelves being attached to the upper edge of the support structure's horizontal portion;

the ends of the shelves being at an angle and aligning with the inner portions of a wider outer part and the middle connecting portion of the vertical portion of the support structure;

outer vertical support elements at vertical ends of the shelf assembly being mirror images of each other, wherein:

the outer vertical support elements comprise two wider outer sections and a narrower middle section between the wider outer sections and the wider outer sections being positioned at an angle to the narrower middle section and the outer vertical support element having folding lines at a junction of the wider outer section and the narrower middle section;

the wider outer sections and the narrower middle sections being configured to be folded to achieve a narrower shape using the folding lines;

one of the wider sections of the outer support element and the narrower middle sections having at least one incision, and at least one of the outer wider sections having at least one folding line, and the at least one incision on the wider section of the support element being a shaped line, and a straight line on the narrower middle section, and the at least one folding line being a straight line;

the incision partially dividing the outer vertical support element into an upper portion and a lower portion of the outer vertical support element;

the outer vertical support element being configured to be foldable vertically downwards at the location of the incision and the folding line;

two opposite vertical prongs located on both sides of the wider portion of the outer vertical support element with the incision;

a slot for insertion of the vertical prong on the lower portion of the outer vertical support element being located behind the vertical prong on the upper portion of the outer vertical support element, locking the parts of the outer vertical support element together;

the vertical portion of the shelf support structure is connected to the outer vertical support element, and the upper shelf assembly portion and the lower shelf assembly portion are independently connected to the outer vertical support element;

the base contains a support structure with extended edges; the header element being configured to be attached to the foldable flap and having a support leg, with a foldable extension of the support leg including a fastener and the header element is configured to provide additional interconnection between the first horizontal surface of the shelf and the second horizontal surface of the shelf, and to further secure the stand assembly system into a three-dimensional set-up state.

2. Foldable cardboard stand assembly system according to claim 1, comprising at least one set of intermediate shelf modules.

3. Foldable cardboard stand assembly system according to claims 1, comprising the shelf assembly having at least one intermediate part of the shelf assembly.

4. Foldable cardboard stand assembly system according to claim 1, comprising the outer vertical support element having at least one intermediate part.

5. Foldable cardboard stand assembly system according to claim 1, comprising a vertical prong located on the inner side of the lower portion of the outer vertical support element, and a vertical prong located on the outer side of the upper portion of the outer vertical support element.

* * * * *